US010935326B2

(12) United States Patent
Sun et al.

(10) Patent No.: US 10,935,326 B2
(45) Date of Patent: Mar. 2, 2021

(54) THERMAL CONDUCTING STRUCTURE

(71) Applicant: COOLER MASTER CO., LTD., New Taipei (TW)

(72) Inventors: Chien-Hung Sun, New Taipei (TW); Te-Hsuan Chin, New Taipei (TW); Lei-Lei Liu, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 10 days.

(21) Appl. No.: 16/444,771

(22) Filed: Jun. 18, 2019

(65) Prior Publication Data

US 2019/0331433 A1 Oct. 31, 2019

Related U.S. Application Data

(62) Division of application No. 15/352,804, filed on Nov. 16, 2016, now Pat. No. 10,371,458.

(30) Foreign Application Priority Data

Apr. 7, 2016 (CN) ..... 201610213189.1

(51) Int. Cl.

| | |
|---|---|
| ***F28D 15/00*** | (2006.01) |
| ***F28D 15/04*** | (2006.01) |
| ***F28D 15/02*** | (2006.01) |
| ***F28F 9/00*** | (2006.01) |
| ***F28F 9/007*** | (2006.01) |
| *F28D 21/00* | (2006.01) |

(52) U.S. Cl.

CPC ..... *F28D 15/046* (2013.01); *F28D 15/0233* (2013.01); *F28F 9/001* (2013.01); *F28F 9/0075* (2013.01); *F28D 15/0275* (2013.01); *F28D 2021/0028* (2013.01)

(58) Field of Classification Search

CPC ..... F28D 15/046; F28D 15/0275; F28D 15/0233; F28D 2021/0028; F28F 9/001; F28F 9/0075

USPC ..... 165/104.26

See application file for complete search history.

(56) References Cited

U.S. PATENT DOCUMENTS

| | | | | |
|---|---|---|---|---|
| 3,661,202 A * | 5/1972 | Moore, Jr. | F28D 15/06 | 165/104.26 |
| 3,986,550 A * | 10/1976 | Mitsuoka | F28D 15/025 | 165/104.21 |
| 5,216,580 A * | 6/1993 | Davidson | F28D 15/0266 | 361/700 |
| 9,618,275 B1 * | 4/2017 | Anderson | F28D 15/046 | |

(Continued)

*Primary Examiner* — Claire E Rojohn, III

(74) *Attorney, Agent, or Firm* — Maschoff Brennan

(57) ABSTRACT

A thermal conducting structure includes a vapor chamber and at least one heat pipe. The vapor chamber has a casing with a through hole formed on a side of the casing, and a chamber defined inside the casing and communicated with the through hole and having a metal mesh covered on an inner wall of the chamber. The heat pipe has a tubular body and an opening formed at an end of the tubular body, and the tubular body is connected to the through hole, and a cavity is defined inside the tubular body. A capillary member is covered onto an inner wall of the cavity. The metal mesh extends through the opening into the cavity to connect the capillary member. The metal mesh is used as a capillary structure, and the vapor chamber and heat pipe are used together to provide a better cooling efficiency.

6 Claims, 7 Drawing Sheets

(56) References Cited

U.S. PATENT DOCUMENTS 9,772,143 B2* 9/2017 Yang ..... F28F 1/32
10,048,017 B2* 8/2018 Lan ..... F28D 15/0233
2004/0118553 A1* 6/2004 Krassowski ..... C04B 41/009 165/104.26
2005/0173098 A1* 8/2005 Connors ..... F28D 15/0233 165/104.33
2005/0178532 A1* 8/2005 Meng-Cheng ..... F28D 15/0233 165/104.33
2007/0272399 A1* 11/2007 Nitta ..... F28D 15/046 165/185
2009/0294117 A1* 12/2009 Hodes ..... H04L 23/38 165/287
2010/0108297 A1* 5/2010 Chen ..... H01L 23/427 165/104.26
2010/0263836 A1* 10/2010 Figus ..... F28D 15/043 165/104.26
2011/0088873 A1* 4/2011 Yang ..... F28D 15/0233 165/104.26
2011/0094723 A1* 4/2011 Meyer, IV ..... H01L 23/427 165/185
2011/0220328 A1* 9/2011 Huang ..... F28D 15/046 165/104.26
2012/0285662 A1* 11/2012 Meyer, IV ..... F28D 15/04 165/104.26
2013/0037242 A1* 2/2013 Chen ..... F28D 15/0233 165/104.26
2013/0105131 A1* 5/2013 Chen ..... F28D 15/046 165/177
2013/0186600 A1* 7/2013 Sun ..... F28D 15/0233 165/104.26
2013/0199757 A1* 8/2013 Meyer, IV ..... H05K 7/2029 165/104.26
2014/0138057 A1* 5/2014 Horng ..... F28D 15/046 165/104.26
2014/0174700 A1* 6/2014 Lin ..... F28D 15/046 165/104.26
2014/0182819 A1* 7/2014 Yang ..... F28D 15/04 165/104.26
2014/0216691 A1* 8/2014 Yang ..... F28D 15/0275 165/104.26
2014/0345831 A1* 11/2014 Lin ..... F28D 15/0233 165/104.26
2014/0345832 A1* 11/2014 Lin ..... F28D 15/046 165/104.26
2016/0003555 A1* 1/2016 Sun ..... F28D 15/0266 165/104.26
2016/0131440 A1* 5/2016 Lee ..... F28D 15/0233 165/185
2016/0187069 A1* 6/2016 Sun ..... F28D 15/043 165/104.26
2016/0219756 A1* 7/2016 Sun ..... F28D 15/0275
2016/0348985 A1* 12/2016 Sun ..... F28D 15/04
2017/0153064 A1* 6/2017 Lan ..... F28D 15/046
2017/0153066 A1* 6/2017 Lin ..... F28F 1/32
2017/0227298 A1* 8/2017 Sun ..... F28D 15/04
2017/0254600 A1* 9/2017 Sun ..... F28D 15/046
2017/0268835 A1* 9/2017 Lin ..... F28D 15/0233
2017/0292793 A1* 10/2017 Sun ..... F28F 9/0075
2017/0314870 A1* 11/2017 Lin ..... F28D 15/00
2017/0328646 A1* 11/2017 Zhou ..... F28D 15/0275
2017/0343298 A1* 11/2017 Lan ..... F28D 15/0266
2017/0356694 A1* 12/2017 Tan ..... B23P 15/26
2018/0066896 A1* 3/2018 Lin ..... H01L 23/427
2018/0106552 A1* 4/2018 Lin ..... H05K 7/20336
2018/0156545 A1* 6/2018 Delano ..... H05K 7/20309
2018/0172326 A1* 6/2018 Cho ..... F25B 39/02

* cited by examiner

THERMAL CONDUCTING STRUCTURE

CROSS-REFERENCE TO RELATED APPLICATIONS

This application is a divisional patent application of U.S. application Ser. No. 15/352,804, filed on Nov. 16, 2016, which claims priority to China Application 201610213189.1, filed on Apr. 7, 2016, which is incorporated by reference herein in its entirety.

FIELD OF THE INVENTION

This disclosure relates to a thermal conducting structure, and more particularly to the thermal conducting structure that uses a metal mesh as a capillary structure to simplify the manufacturing process and integrates a vapor chamber and a heat pipe.

BACKGROUND OF THE INVENTION

With the evolution of times, the demands for electronic products becomes increasingly higher; and with the increase of processing speed and performance of a central processing unit (CPU), the heat generated by the CPU becomes increasing larger. The problem of thermal management of electronic products that has not been valued for a long time gradually emerges and becomes an issue that cannot be ignored. The working clock of the central processing unit (CPU) is increased from 1 GHza to 3 GHz, and thus the consumed power is increased from 20 W to 130 W or greater, and the heat flux is also increased to 150 W/cm$^2$ or greater. To meet the multitasking requirement of the electronic products, it is necessary build more integrated circuit (IC) chips in a limited volume, and the heat generated by the IC chips will affect one another, so that the operating environment of the IC chips is getting worse and may even threat the normal operation and service life of the IC chips.

However, most conventional electronic components just adopt a heat pipe or a vapor chamber which is insufficient for the heat dissipation of the electronic components. Since the heat pipe has the issue of a high spreading resistance, and the vapor chamber has the issue of a narrow heat transfer direction, it is an important and urgent subject to find a way of integrating a heat pipe and a vapor chamber for an effective thermal management, so that the working fluid can be circulated between the heat pipe and the vapor chamber, and the electronic products can be operated effectively and developed in the direction of multitasking continuously.

In view of the aforementioned drawbacks of the prior art, the disclosure of this disclosure based on years of experience in the related industry to conduct extensive research, and finally developed a thermal conducting structure according to this disclosure to overcome the drawbacks of the prior art.

SUMMARY OF THE INVENTION

Therefore, it is a primary objective of the present invention to provide a thermal conducting structure that uses a metal mesh structure as a capillary structure and connects and combines a vapor chamber and a heat pipe to form the thermal conducting structure with a better cooling efficiency.

To achieve the aforementioned and other objectives, this disclosure provides a thermal conducting structure comprising a vapor chamber and at least one heat pipe, and the vapor chamber includes a casing with at least one through hole formed on a side of the casing, a chamber defined inside the casing and communicated with the through hole, and a metal mesh covered onto an inner wall of the chamber; and the heat pipe includes a tubular body and an opening formed at an end of the tubular body, and the tubular body is passed and coupled to the through hole by an end of the opening, and a cavity is defined inside the tubular body, and a capillary member is covered onto an inner wall of the cavity, wherein, the metal mesh extends through the opening into the cavity to connect the capillary member.

To achieve the aforementioned and other objectives, this disclosure also provides a thermal conducting structure comprising a vapor chamber and at least one heat pipe, and the vapor chamber includes a casing with at least one through hole formed on a side of the casing, a chamber defined inside the casing and communicated with the through hole, and a capillary member covered onto an inner wall of the chamber; and the at least one heat pipe includes a tubular body and an opening formed on a side of the tubular body, and the tubular body is passed and coupled to the through hole by an end of the opening, and a cavity is defined inside the tubular body, and a metal mesh is covered onto an inner wall of the cavity; wherein, the metal mesh extends out from the opening to connect the capillary member.

In an embodiment of this disclosure, the metal mesh is a capillary structure made of copper, aluminum, or stainless steel.

In an embodiment of this disclosure, the metal mesh of the vapor chamber includes a capillary body and a capillary extension coupled to the capillary body, and having a vertical bend disposed at the junction of the capillary body and the capillary extension, and the capillary extension is extended into the cavity to attach the capillary member.

In an embodiment of this disclosure, the metal mesh of the heat pipe includes a capillary body and a capillary extension coupled to the capillary body, and having a vertical bend disposed at the junction of the capillary body and the capillary extension, and the capillary extension is extended into the cavity to attach the capillary member.

In an embodiment of this disclosure, the heat pipe and the through hole come with plural quantities respectively, and the heat pipes are disposed on the same side or different sides of the vapor chamber.

This disclosure has the following effects. The thermal conducting structure is sintered directly with the metal mesh and extended and attached directly onto the capillary member, and the manufacturing method of the directly sintered metal mesh is simple and easy, and the structure has a relatively smaller contact resistance, so that the working fluid can return from the heat pipe to the vapor chamber more efficiently, and the structure also has the advantages of the low spreading resistance of the vapor chamber as well as the wide heat transfer direction of the heat pipe.

DESCRIPTION OF THE PREFERRED EMBODIMENTS

The technical contents of the present invention will become apparent with the detailed description of preferred embodiments accompanied with the illustration of related drawings as follows. It is noteworthy that the preferred embodiments are provided for illustrating this disclosure rather than restricting the scope of the disclosure.

Figure 1:
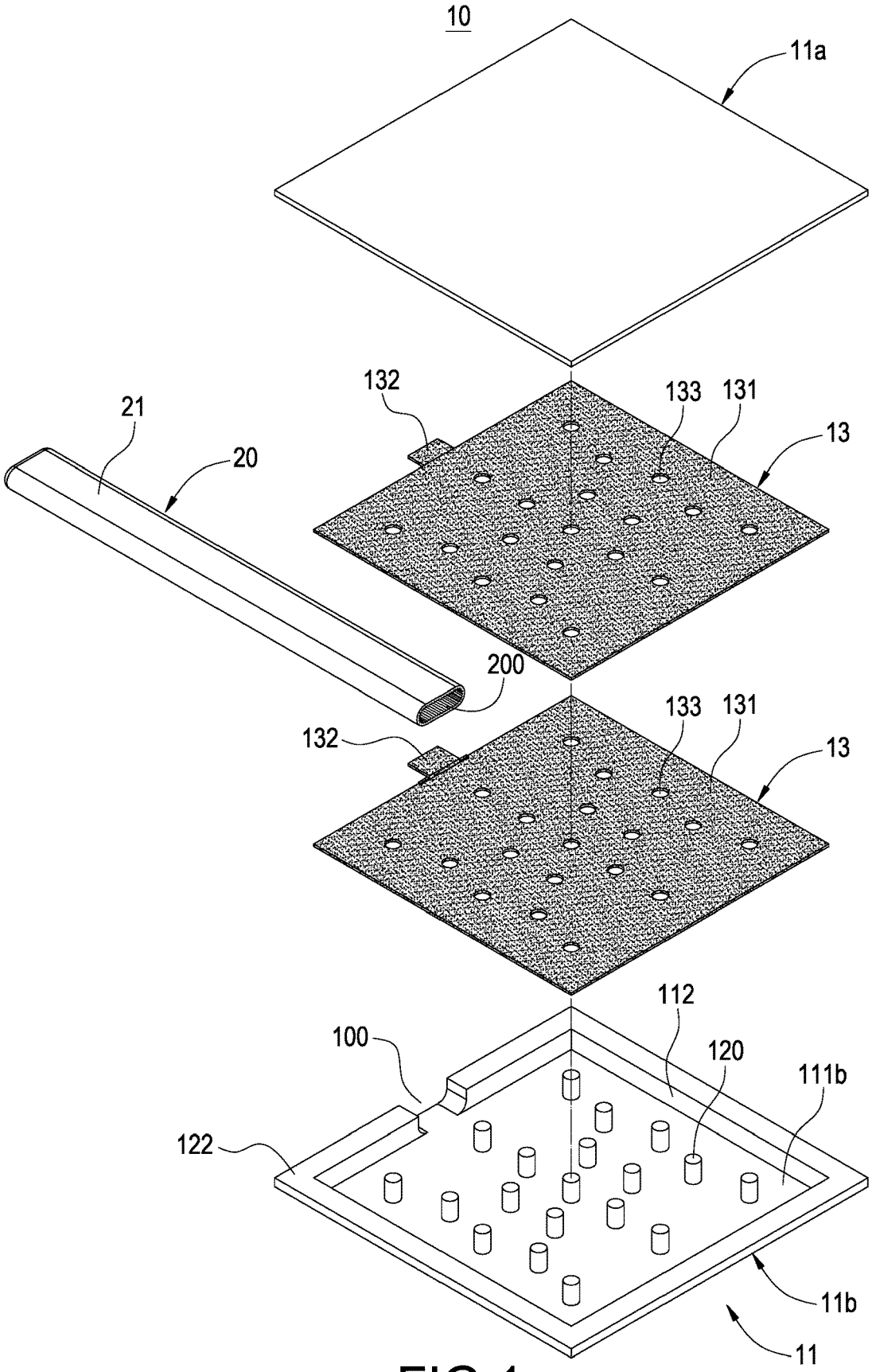
FIG. 1 is an exploded view of a thermal conducting structure of this disclosure.
Figure 2:
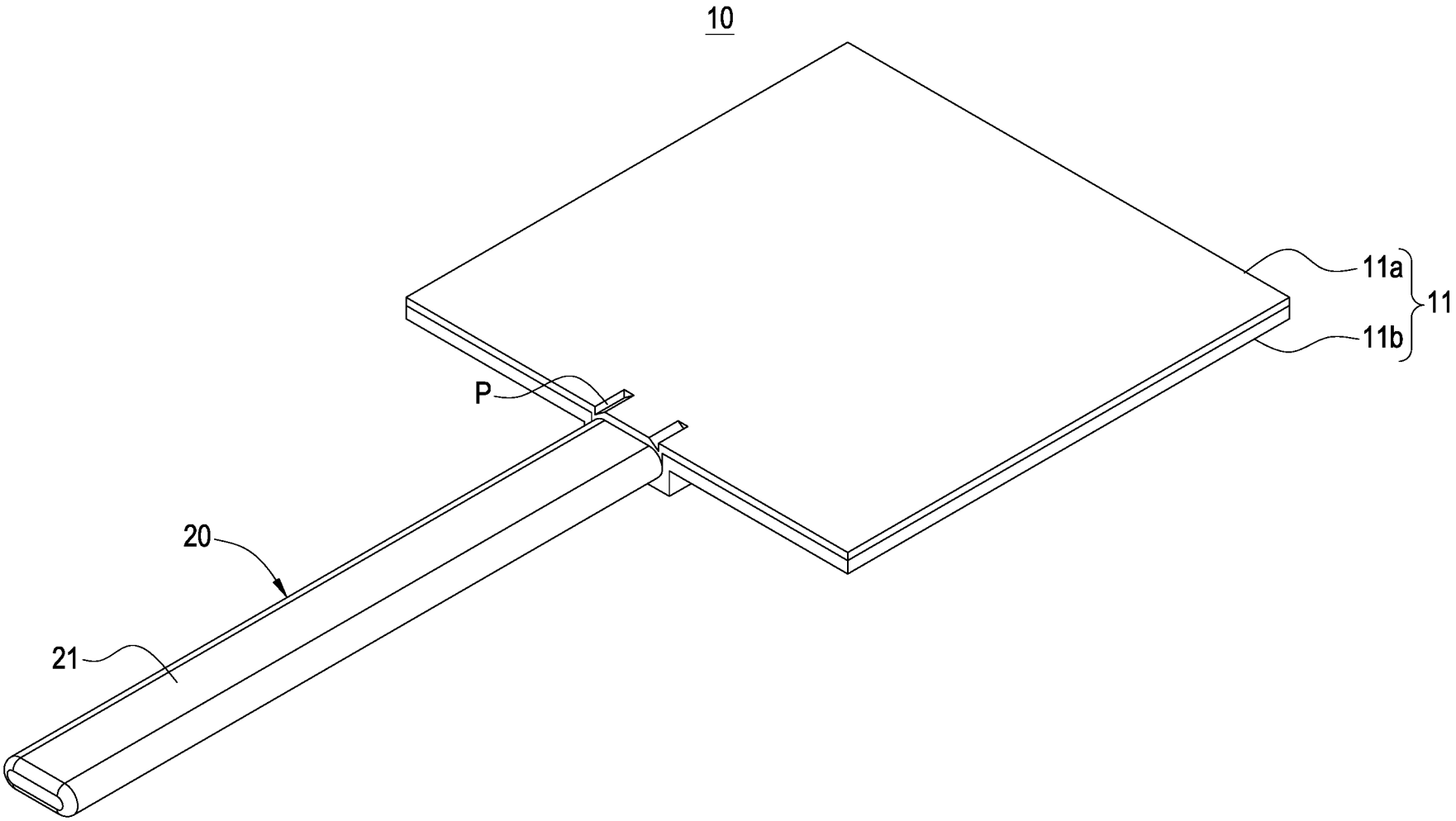
FIG. 2 is a perspective view of a thermal conducting structure of this disclosure.
Figure 3:
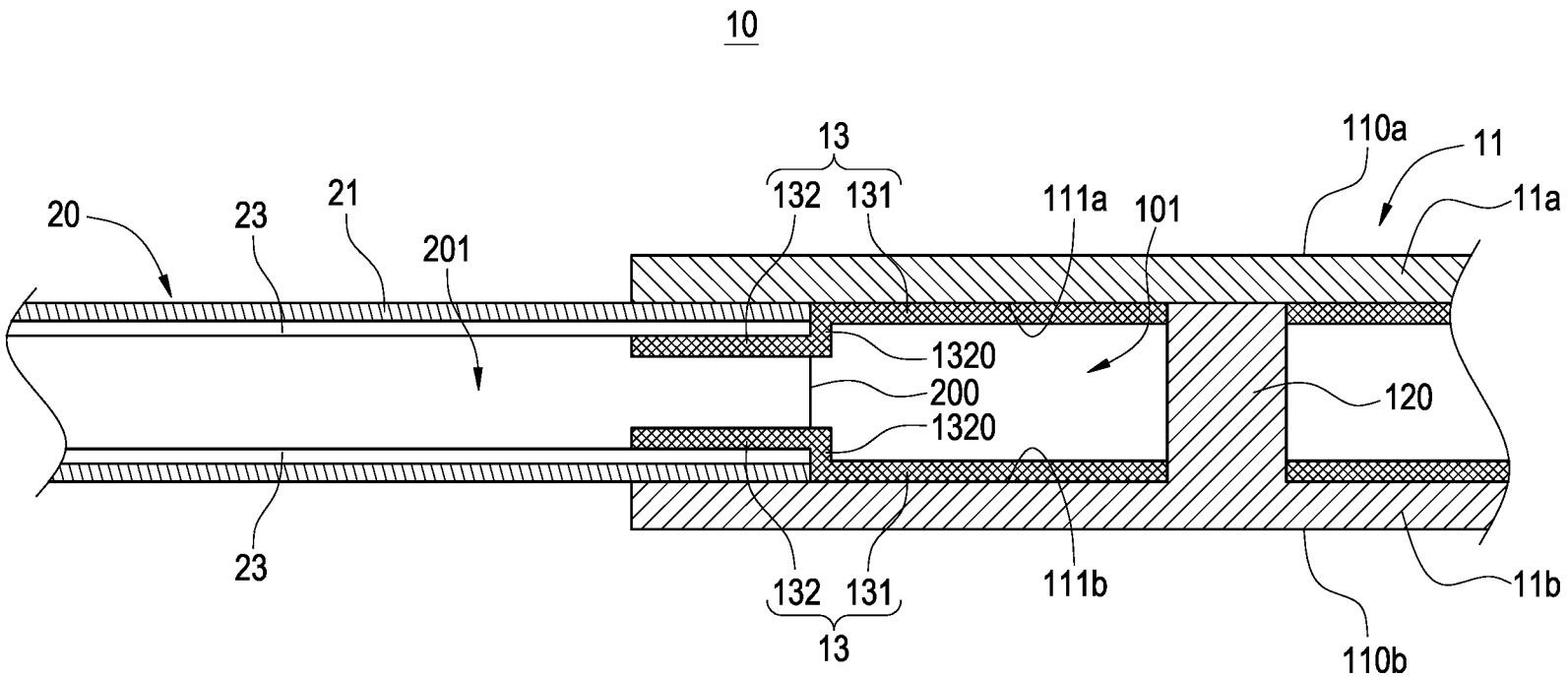
FIG. 3 is a cross-sectional view of a capillary member of a first embodiment of this disclosure.

With reference to FIGS. 1 to 3 for a thermal conducting structure in accordance with the first embodiment of this disclosure, the thermal conducting structure comprises a vapor chamber 10 and at least one heat pipe 20 coupled to the vapor chamber 10.

The vapor chamber 10 includes a casing 11 and at least one through hole 100 formed on a side of the casing 11, and the casing 11 is formed by engaging a first casing member 11*a* and a second casing member 11*b* by a stamping, forging or machining method to form a sealed casing 11, and the first or second casing has a fence portion 122 to define a chamber 101 in the vacuum interior of the casing 11, and the chamber 101 is communicated with the through hole 100 and provided for flowing a working fluid (not shown in the figure), and the top, bottom and the periphery of the chamber 101 have an inner top wall 111*a*, an inner bottom wall 111*b* and an inner peripheral wall 112, and the through hole 100 is disposed on a side of the casing 11. In other words, the through hole 100 is formed at the fence portion 122, and the inner bottom wall 111*b* has a plurality of spaced prop columns 120 abutted against the inner top wall 111*a* to provide the support. Further, the first casing member 11*a* and the second casing member 11*b* are made of a metal such as copper.

Wherein, a metal mesh 13 is covered onto an inner wall of the chamber 101. In this embodiment, the metal mesh 13 is completely covered onto the inner top wall 111*a* and the inner bottom wall 111*b* to form the capillary structure of the vapor chamber 10, and the metal mesh 13 is made of a sintered copper powder and in form of a metal mesh structure, and attached onto the inner top wall 111*a* and the inner bottom wall 111*b* by directly sintering the copper mesh, or a diffusion bonding method or formed on the inner top wall 111*a*, the inner bottom wall 111*b* and the inner peripheral wall 112 to form the connected metal mesh 13, and the metal mesh 13 is made of a material including but not limited to copper, aluminum or stainless steel. In this embodiment, the method of directly sintering the copper mesh is used to form the capillary structure, and the related manufacturing process is simple and highly stable, and the manufactured structure has a strong capillary force to reduce the contact resistance between the layers of the metal meshes.

The heat pipe 20 includes a tubular body 21 and an opening 200 formed at a free end of the tubular body 21, and a cavity 201 is defined inside the tubular body 21, and the free end of the tubular body 21 is passed and coupled to the through hole 100 and a part of the tubular body 21 is extended into the chamber 101, wherein a capillary member 23 is completely covered onto the inner wall of the tubular body 21, and the capillary member 23 includes but not limited to a metal mesh, a fiber, a sintered powder and a groove, and the metal mesh 13 is passed through the opening 200 and coupled to the capillary member 23. Further, the heat pipe 20 and the vapor chamber 10 are bonded and sealed by a stamping process, so that a press mark P is formed at the junction of the casing 11 and the tubular body 21, and the heat pipe 20 and the vapor chamber 10 are fixed with each other.

Wherein, the metal mesh 13 includes a capillary body 131 and a capillary extension 132 coupled to the capillary body 131, and the capillary extension 132 has a vertical bend 1320 disposed at the junction with the capillary member 23 of the heat pipe 20, and the capillary extension 132 is formed and extended from the vertical bend 1320 into the cavity 201 to attach the capillary member 23. When the metal mesh 13 is sintered in the casing 11, a plurality of penetrating holes 133 of the prop columns 120 is formed in the capillary body 131 after the metal mesh 13 is sintered, and the prop columns 120 are passed through the penetrating holes 133 and abutted against the inner top wall 111*a*, so that the heat pipe 20 and the vapor chamber 10 can be combined with each other and used altogether, and a working fluid may be circulated between the interior of the heat pipe 20 and the interior of the vapor chamber 10.

Figure 4:
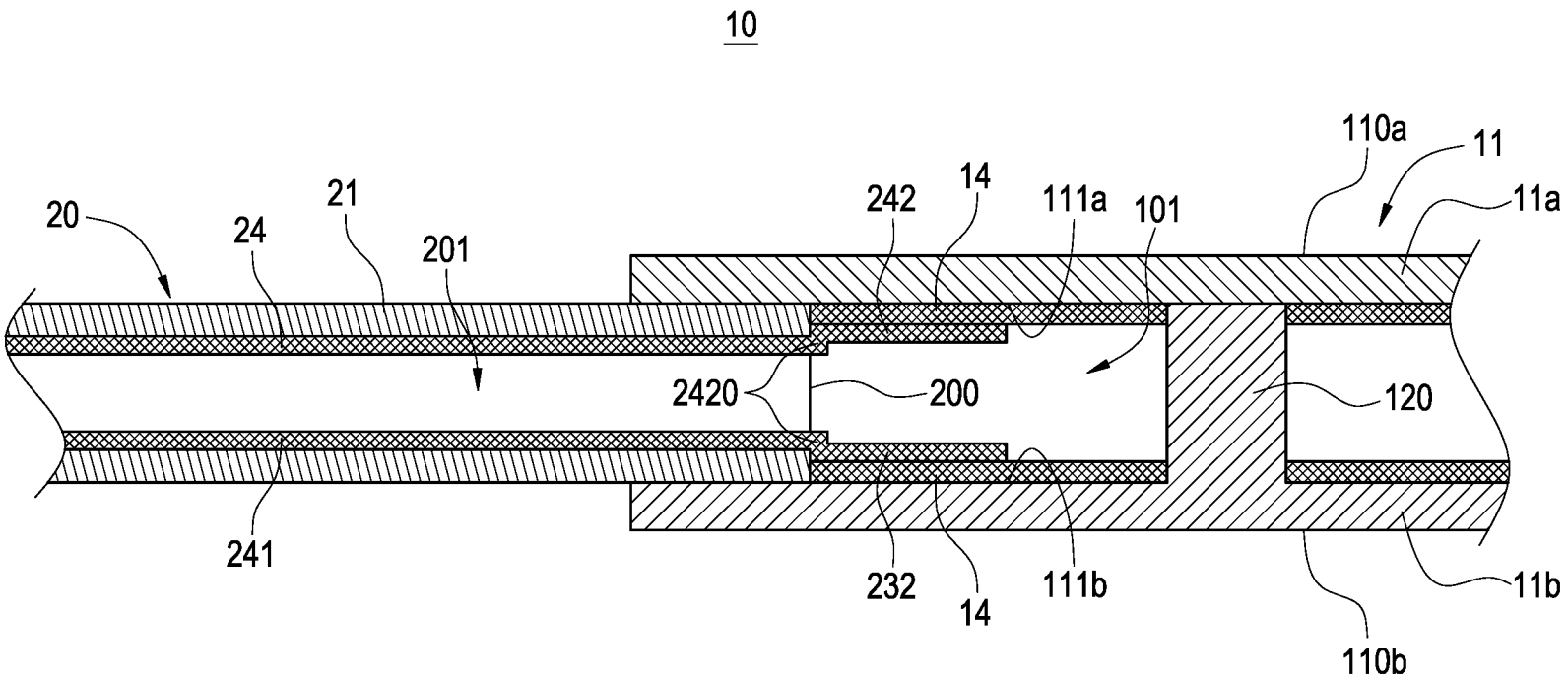
FIG. 4 is a cross-sectional view of a capillary member of a second embodiment of this disclosure.

With reference to FIG. 4 for a capillary member of a thermal conducting structure in accordance with the second embodiment of this disclosure, the main difference between this embodiment and the previous embodiment resides on the different capillary structures of the casing 11 and the tubular body 21.

In this embodiment, an inner wall of the cavity 201 of the tubular body 20 is covered by a metal mesh 24, and a capillary member 14 is covered onto the chamber 101 of the casing 11, wherein the metal mesh 24 is passed through the opening 200 and coupled to the capillary member 14, and the metal mesh 24 is made of a sintered copper powder and attached around the inner wall of the tubular body 21 in form of a copper mesh structure by directly sintering the copper mesh or a diffusion bonding method, and the metal mesh 24 is made of a material including but not limited to copper, aluminum, and stainless steel. In this embodiment, the method of directly sintering the copper mesh to form the capillary structure. In addition, the capillary member 14 of the casing 11 is attached onto the inner top wall 111*a* and the inner bottom wall 111*b*, or formed on the inner top wall 111*a*, the inner bottom wall 111*b* and the inner peripheral wall 112, or attached onto the outer peripheral wall of the prop column 120 to form the connected capillary structure, and the capillary member 14 includes but not limited to a metal mesh, a fiber, a sintered powder, and a groove.

Wherein, the metal mesh 24 includes a capillary body 241 and a capillary extension 242 coupled to the capillary body 241, and the capillary extension 242 at its junction with the capillary member 14 of the vapor chamber 10 has a vertical bend 2420, and the capillary extension 242 is formed and extended from the vertical bend 2420 into the chamber 101 of the casing 11 to attach the capillary member 14, so that the heat pipe 20 and the vapor chamber 10 are combined with each other and used altogether, and a working fluid may be circulated between the interior of the heat pipe 20 and the interior of the vapor chamber 10.

Figure 5:
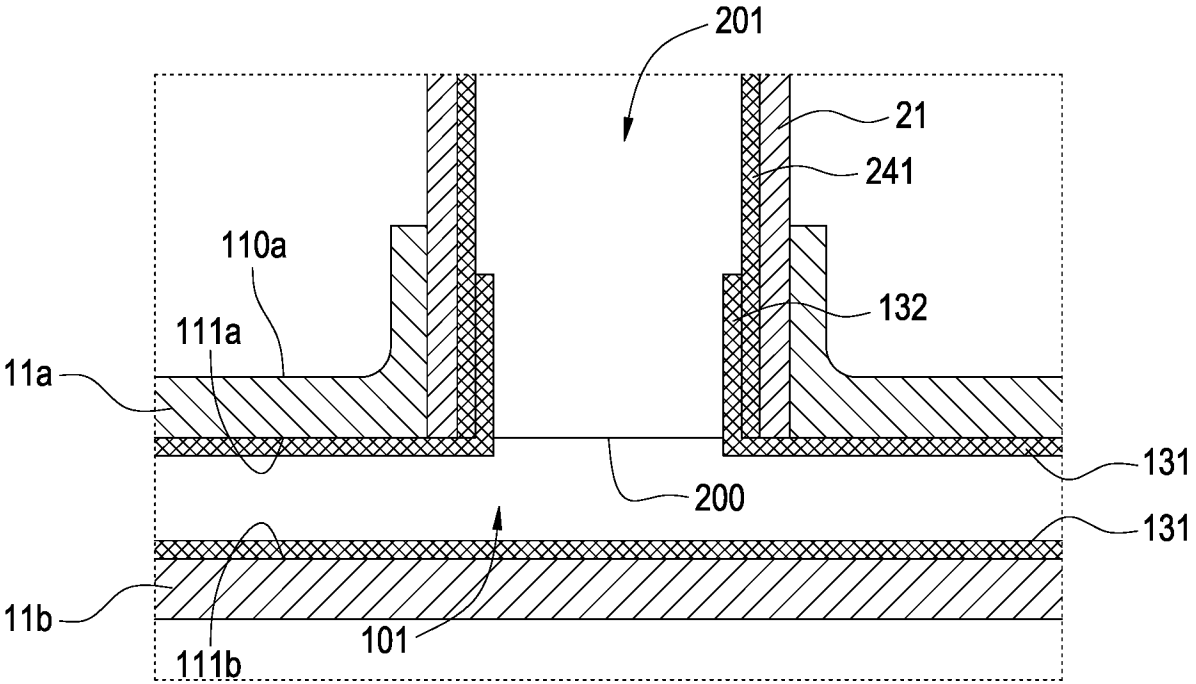
FIG. 5 is a cross-sectional view of a capillary member of a third embodiment of this disclosure.

With reference to FIGS. 3 to 5 for a capillary member of a thermal conducting structure in accordance with the third embodiment of this disclosure, the main difference between this embodiment and the first embodiment resides on the configuration of the heat pipe 20 combined with the vapor chamber 10 as described below.

In this embodiment, the through hole 200 is disposed on an outer wall 110*a* of the first casing member 11*a*, and the tubular body 21 is passed through the through hole 200 but not protruded beyond the inner top wall 111*a*, and it is vertically installed on the outer wall 11*a* and perpendicular to the casing 11, wherein the capillary body 131 of the metal mesh 13 in the chamber 101 is covered onto the inner top wall 111*a* and the inner bottom wall 111*b*, and the capillary body 131 covered onto the inner top wall 111*a* has the capillary extension 132 formed and bent at a position next to the through hole 200 and extended in a direction towards the tubular body 21, and the capillary extension 132 is attached to the capillary member 23 of the tubular body 21.

Figure 6:
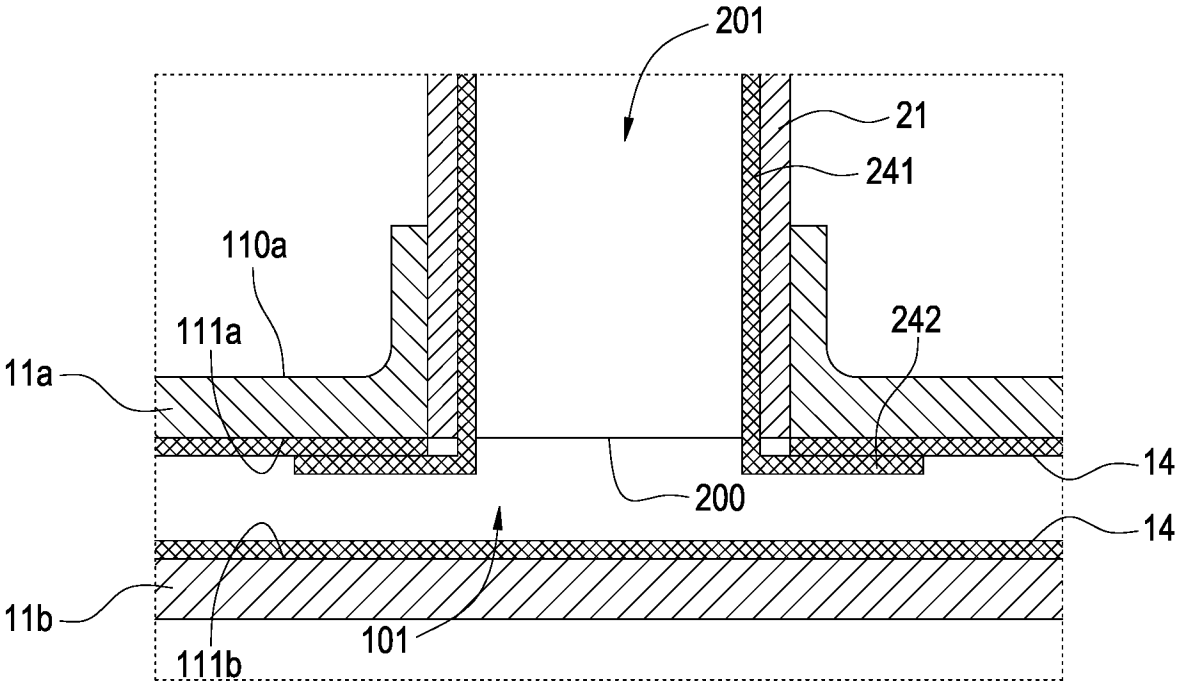
FIG. 6 is cross-sectional view of a capillary member of a fourth embodiment of this disclosure.

With reference to FIGS. 4 and 6 for a capillary member of a thermal conducting structure in accordance with the fourth embodiment of this disclosure, the main difference between this embodiment and the second embodiment resides on the configuration of the heat pipe 20 combined with the vapor chamber 10 as described below.

In this embodiment, the through hole 200 is disposed on an outer wall 110*a* of the first casing member 11*a*, and the tubular body 21 is passed through the through hole 200 but not protruded beyond the inner top wall 111*a* and disposed vertically on the outer wall 11*a* and perpendicular to the casing 11, wherein the capillary body 241 of the metal mesh 24 covered onto the cavity 201 has a capillary extension 242 formed and bent at a position next to the through hole 200 and extended along the inner top wall 111*a* of the first casing member 11*a*, and the capillary extension 242 is attached to the capillary member 14 covered onto the inner top wall 111*a*.

Figure 7:
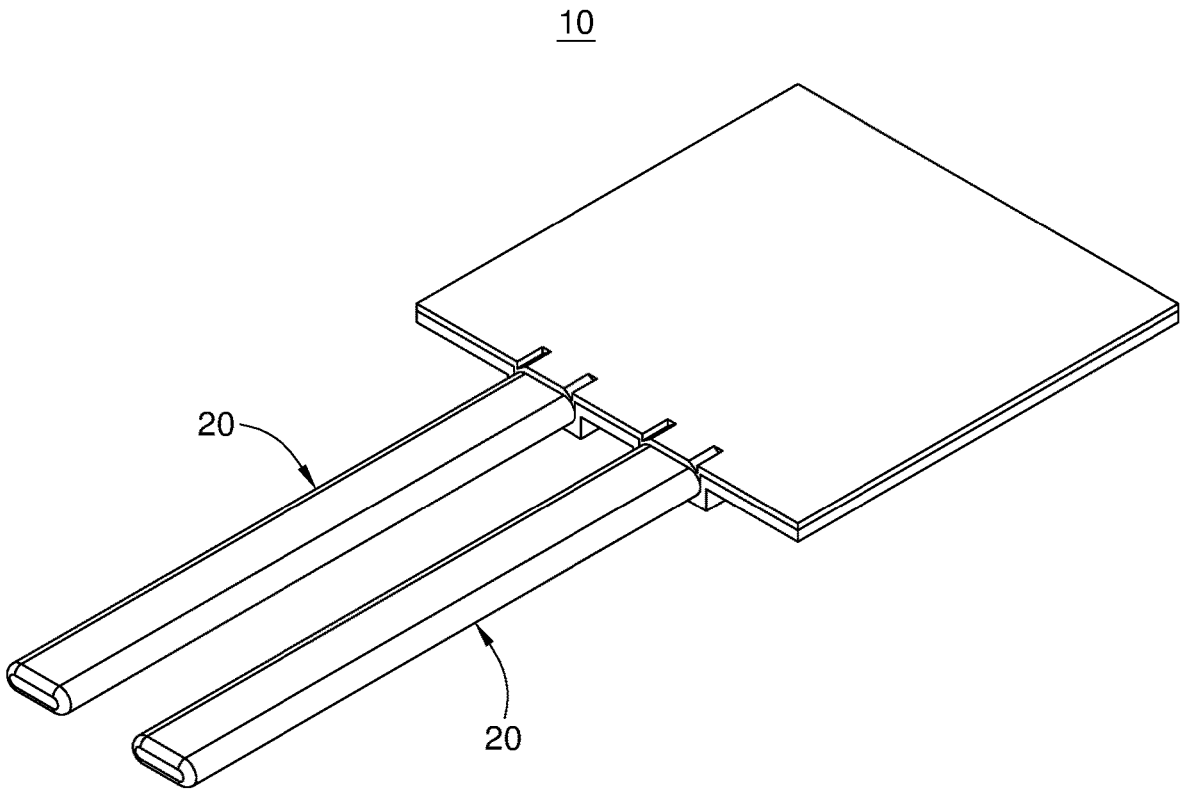
FIG. 7 is a perspective view of a thermal conducting structure in accordance with another embodiment of this disclosure.

With reference to FIGS. 1 to 6 for the first to fourth embodiments of this disclosure, the heat pipe 20 of these embodiment may be in a round tube structure or a round flat tube structure, and the round flat tube structure is used in some embodiment to save space and facilitate attaching the heat source, but this disclosure is not limited to such arrangement only. Please refer to FIG. 7, which is a perspective view of a thermal conducting structure in accordance with another embodiment of this disclosure. The thermal conducting structure of this embodiment has a configuration similar to that of the first or the second embodiments. In this embodiment, there are a plurality of heat pipes 20. The fence portion has a plurality of through holes for passing the plurality of heat pipes 20 respectively, and the heat pipes 20 are passed and coupled to the through holes and installed on the same side of the vapor chamber 10 and arranged parallel to the vapor chamber 10. In other embodiments, there may be at least one through hole formed on different sides of the fence portion, and the quantity of the through holes is the same as the quantity of the heat pipes, so that the heat pipes can be installed on different sides of the vapor chamber and arranged parallel to the vapor chamber, but this disclosure is not limited to such arrangement only and may be designed as needed. The metal mesh may be sintered directly and attached onto the capillary member directly, and such method of sintering the metal mesh directly is simple and easy and achieves a smaller contact resistance, so that a working fluid can return from the heat pipe to the vapor chamber more efficiently, and the thermal conducting structure of this disclosure also has the advantages of the low spreading resistance of the vapor chamber as well as the wide heat transfer direction of the heat pipe.

While the invention has been described by means of specific embodiments, numerous modifications and variations could be made thereto by those skilled in the art without departing from the scope and spirit of the invention set forth in the claims.

What is claimed is:

1. A thermal conducting structure, comprising:

a vapor chamber, including a casing with at least one through hole formed on a side of the casing, a chamber defined inside the casing and communicated with the at least one through hole, and a metal mesh covered onto an inner wall of the chamber; and at least one heat pipe, including a tubular body and an opening formed at an end of the tubular body, and the tubular body being passed and coupled to the at least one through hole by an end of the opening, and a cavity being defined inside the tubular body, and a capillary member being covered onto an inner wall of the cavity;

wherein, the metal mesh extends through the opening into the cavity to connect the capillary member.

2. The A thermal conducting structure comprising:

a vapor chamber, including a casing with at least one through hole formed on a side of the casing, a chamber defined inside the casing and communicated with the at least one through hole, and a metal mesh covered onto an inner wall of the chamber; and at least one heat pipe, including a tubular body and an opening formed at an end of the tubular body, and the tubular body being passed and coupled to the at least one through hole by an end of the opening, and a cavity being defined inside the tubular body, and a capillary member being covered onto an inner wall of the cavity;

wherein, the metal mesh extends through the opening into the cavity to connect the capillary member;

wherein the metal mesh includes a capillary body and a capillary extension coupled to the capillary body, the capillary extension has a vertical bend disposed at a junction of the capillary body and the capillary extension, and the capillary extension is extended into the cavity to attach the capillary member.

3. The thermal conducting structure of claim 2, wherein the casing includes a first casing member and a second casing member, and the second casing member has a plurality of prop columns disposed on an inner bottom wall of the chamber, and the capillary body has a plurality of penetrating holes which are through holes, and the prop columns are passed through the penetrating holes and abutted against and in direct contact with the first casing member at an inner top wall in the chamber.

4. The thermal conducting structure of claim 3, wherein the inner bottom wall and the inner top wall are covered by the mesh metal.

5. The thermal conducting structure of claim 3, wherein any one of the first casing member and the second casing member has a peripheral fence portion to form an inner peripheral wall of the chamber, and the inner bottom wall, the inner peripheral wall and the inner top wall are covered by the metal mesh.

6. The thermal conducting structure of claim 5, wherein the metal mesh further includes an outer peripheral wall completely covered onto the prop columns.

* * * * *